US007707749B2

(12) United States Patent
Giovale et al.

(10) Patent No.: US 7,707,749 B2
(45) Date of Patent: May 4, 2010

(54) MODULAR SNOW TRAVEL SYSTEM FOR COMMON FOOTWEAR

(75) Inventors: Daniel G. Giovale, Flagstaff, AZ (US); William J. Perkins, Leadville, CO (US)

(73) Assignee: Kahtoola, Inc., Flagstaff, AZ (US)

( * ) Notice: Subject to any disclaimer, the term of this patent is extended or adjusted under 35 U.S.C. 154(b) by 660 days.

(21) Appl. No.: 11/622,038

(22) Filed: Jan. 11, 2007

(65) Prior Publication Data

US 2008/0010865 A1 Jan. 17, 2008

Related U.S. Application Data

(60) Provisional application No. 60/758,890, filed on Jan. 12, 2006.

(51) Int. Cl.
*A43B 5/00* (2006.01)

(52) U.S. Cl. ..... 36/124; 36/67 A

(58) Field of Classification Search ..... 36/122–125, 36/7.1 R, 67 A

See application file for complete search history.

(56) References Cited

U.S. PATENT DOCUMENTS 4,620,375 A 11/1986 Wallace
5,901,471 A * 5/1999 Warner ..... 36/124
6,256,908 B1 * 7/2001 Warner ..... 36/124
6,374,518 B2 * 4/2002 Warner ..... 36/124
7,047,673 B2 * 5/2006 Dodge ..... 36/122
2001/0039749 A1 11/2001 Warner
2004/0148802 A1 8/2004 Soriano

FOREIGN PATENT DOCUMENTS

DE 199 18 871 11/2000

* cited by examiner

*Primary Examiner*—Marie Patterson
(74) *Attorney, Agent, or Firm*—Connolly Bove Lodge & Hutz

(57) ABSTRACT

A modular snow travel system for common footwear includes a first traction component which may be an overboot. The first traction component includes at least one traction cleat having latch, such as an exposed hook portion, for engagement with a snowdeck. The engagement is effected by a releasable locking mechanism on the snowdeck. The releasable locking mechanism includes a transversely movable slider and a longitudinally movable slider having contacting cam faces. The lateral position of the transverse slider determines the longitudinal position of the longitudinal slider so that the longitudinal slider could be moved longitudinally to and from a position where a catch on the longitudinal slider is engaged in the hook portion or is disengaged from the latch of the traction cleat.

33 Claims, 6 Drawing Sheets

MODULAR SNOW TRAVEL SYSTEM FOR COMMON FOOTWEAR

CROSS-REFERENCE TO RELATED APPLICATION

This application is based upon provisional application Ser. No. 60/758,890, filed Jan. 12, 2006.

BACKGROUND OF INVENTION

Various attempts have been made to provide structure for securing footing on a variety of slippery surfaces. Such attempts have included footwear such as overboots into which the conventional footwear would be placed with traction cleats attached to the bottom of the overboot sole. This would help provide improved traction when walling or running on ice, snow or other slippery surfaces.

Independently of such cleated overboots, for use in deep snow or where greater stability is required a snowdeck has also been used. Such snowdeck could be attached to the user's footwear and would be of enlarged size to facilitate walling in deep snow.

Until the present invention no one has developed a cleated overboot that provides all of the benefits that may be desirable for such a device. Moreover, until the present invention, no one has provided a cleated overboot that can be readily attached and detached from a snowdeck so as to allow for quick and easy transitions between smooth slippery conditions and deep snow conditions.

SUMMARY OF INVENTION

An object of this invention is to provide an improved system for securing footing on a variety of slippery surfaces.

A further object of this invention is to provide such a system which includes a first traction component having the capability of itself providing secure footing on various surfaces, but also having the capability of being mounted to a snowdeck to increase the secure footing.

In a preferred practice of this invention the first traction component includes at least one traction cleat. The system also includes a snowdeck which preferably has a releasable locking mechanism for selective engagement with the traction cleat so that the traction cleat has the dual function of assisting in providing secure footing when the first traction component is used alone or for acting as structure to mount the first traction component to the snowdeck.

In a preferred practice of this invention the releasable locking mechanism includes a catch which would be engaged by an exposed latch in the form of a protrusion or cutout/hole or hook structure on the traction cleat. The locking mechanism also includes a member for activating the catch to selectively engage/disengage the cleat. Preferably, the catch is in the form of a rod mounted on a longitudinal slider. The activating member is secured to a transverse slider which has a cam face disposed against a cam face of the longitudinal slider. Sideways movement of the transverse slider controls the longitudinal movement or positioning of the longitudinal slider. In this manner the catch can be moved to and from its engaging position and its disengaging position.

The first traction component may be an overboot which has sets of traction cleats disposed on the lower surface of its sole with the traction cleat that engages the snowdeck being located on the forefoot region of the overboot.

The improved system also includes novel heel structure which prevents cleats on the traction component from damaging the snowdeck.

THE DRAWINGS

DETAILED DESCRIPTION

The present invention is directed to providing a modular snow travel system for common footwear. In one practice of the invention a first flexible or inflexible traction component is provided which is adapted to be attached to conventional footwear such as running shoes or other types of footwear or to the foot itself. The first traction component could be an overboot which will be described with greater particularity or could simply be some form of binding assembly that could be attached to the footwear or the foot and fulfill all the other basic functions required of the first traction component and would be secured only in part over the footwear or foot.

The first traction component has at least one traction cleat attached thereto, preferably in the forefoot region, so as to provide improved traction when walking or running on ice, snow or other slippery surfaces. For use in deep snow or where greater stability is required, a snowdeck is also provided that includes a locking mechanism adapted to secure to at least one of the cleats of the first traction component and attach it to the snowdeck. Preferably the attachment to the snowdeck allows for the first traction component to pivot relative to the snowdeck to allow for ease in walking or running. Also preferably, the snowdeck includes additional traction cleats or claws attached thereto.

The present invention provides a number of improved first traction components that are adapted to attach to a wide variety of conventional footwear styles, including boots, shoes, and running shoes or to the foot. Preferably the first traction components include one or more buckle systems to allow for quick attachment to and removal from the foot/footwear. These various forms of first traction components provide greatly improved traction for the wearer while also providing additional benefits, such as with the overboot embodiments that provide improved insulation and protection from snow, dirt, or water infiltration of the footwear. Traction cleats may be provided on the forefoot, rear-foot, or mid-foot of the first traction component, or any combination thereof.

The various embodiments of the snowdecks allow for easy step-in addition of additional floatation and/or greater stability for the wearer. Preferably at least one of the traction cleats of the first traction component is adapted to "click in" to a binding or locking mechanism on the snowdeck. When the deck is no longer required, the locking mechanism allows for quick disengaging of the first traction component. Alternatively, utilizing the quick attachment systems on the first traction components, the wearer can leave the first traction component attached to the snowdeck and convert between conventional footwear and something akin to a conventional snowshoe configuration. Various snowdeck configurations and binding systems may be used within the scope of the present invention.

Figure 1:
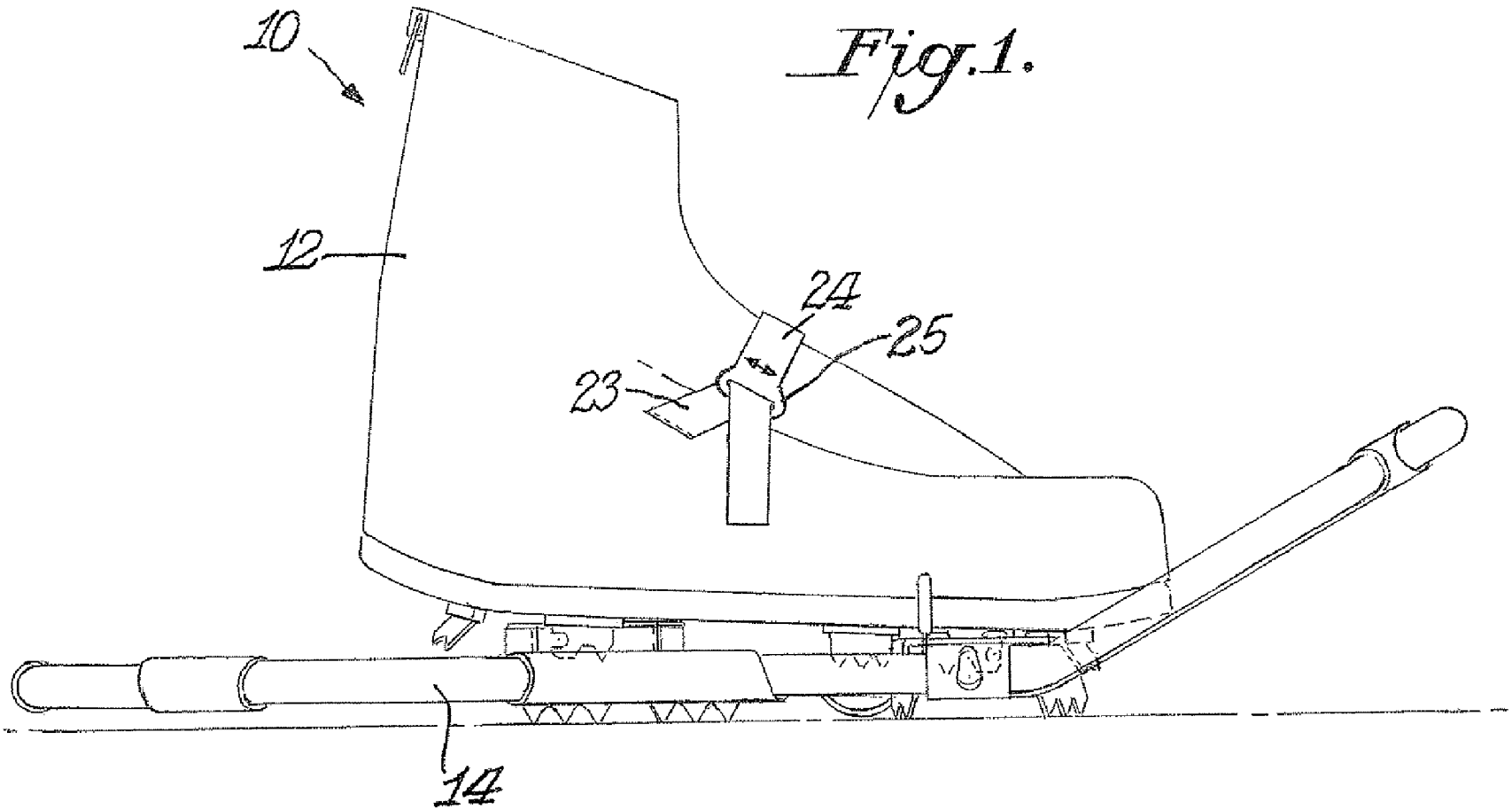
FIG. 1 is a side elevational view of a modular snow travel system in accordance with this invention.

The following description will be directed to a preferred form of modular snow travel system. Such system 10 is illustrated in FIG. 1. As shown therein a first traction component, which in FIG. 1 is in the form of an overboot 12, is detachably mounted to a snowdeck 14.

Figure 2:
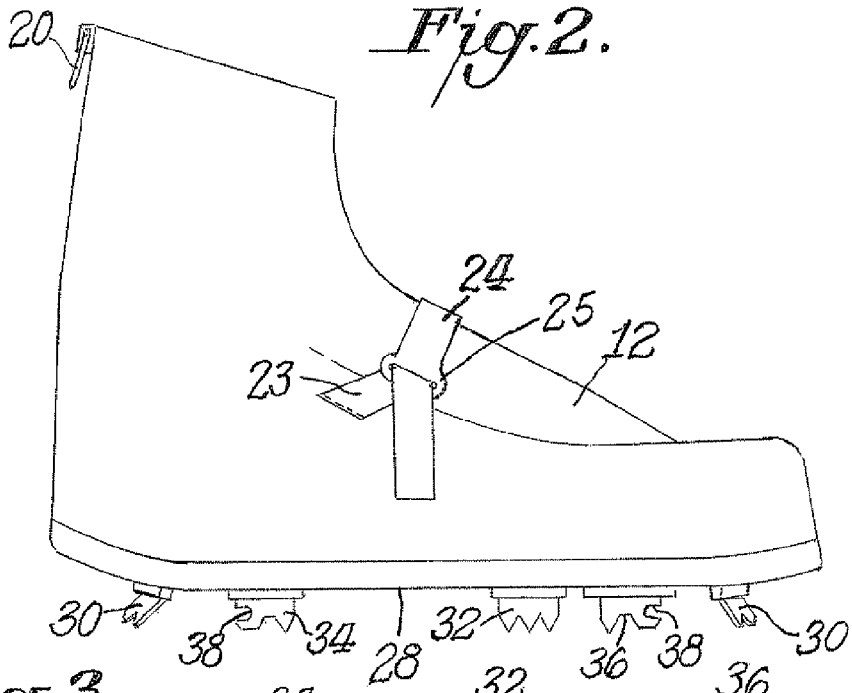
FIG. 2 is a side elevational view of the overboot component of the system shown in FIG. 1.
Figure 3:
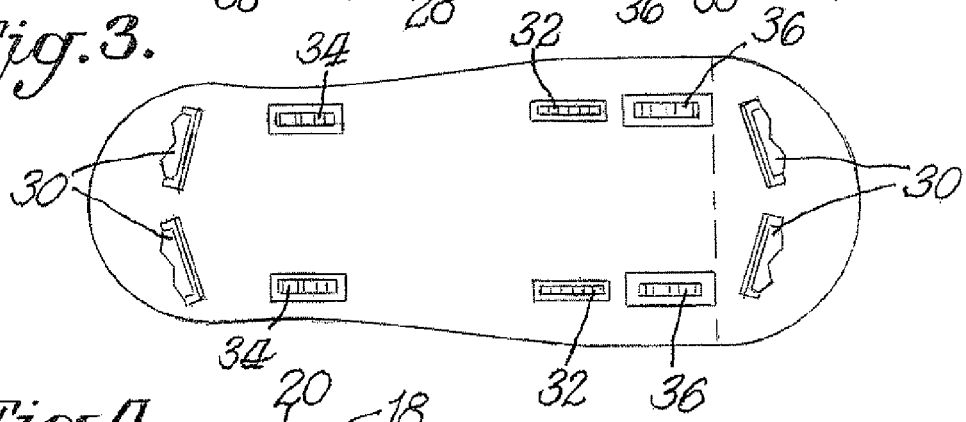
FIG. 3 is a bottom plan view of the overboot shown in FIG. 2.
Figure 4:
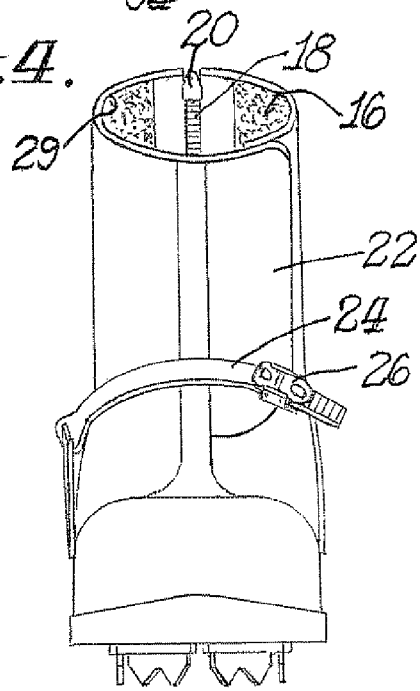
FIG. 4 is a front elevational view of the overboot shown in FIGS. 2-3.

FIGS. 2-4 illustrate the overboot 12 in greater detail. As shown therein overboot 12 can include structure to facilitate a wearer readily inserting the wearer's foot into the overboot 12. This can be done by slipping the foot and any footwear into the opening 16 at the top of the overboot 12. Opening 16 can be increased in size by providing, for example, a zipper 18 having a slider 20 on the back of overboot 12. In addition, the front of the footwear could include a flap 22 that could be opened and then later closed and held in the closed condition through any suitable fastening arrangement such as illustrated by strap structure 24 and fastener structure, such as ratchet 26. It is to be understood that these forms of enlarging the opening 16 may vary in any conventional manner. Preferably, the front opening 16 may be additionally secured through use of supplemental closure devices, such as hook-and-loop fasteners, latches, laces, zippers, or the like, that can both aid in more securely holding the overboot 12 to the wearer and to assist in reducing snow, dirt or water infiltration into the overboot 12.

As best shown in FIGS. 1-2 and 4 an advantageous feature of overboot 12 is the inclusion of a loop 23 on each side of the overboot which slides through a strap loop 25 allowing for the precise placement of the strap structure 24 to be adjusted up or down the boot to accommodate laces hot spots. As best shown in FIG. 4 the strap structure 24 also includes a series of transverse teeth 27 which cooperate with ratchet 26 for providing the adjustability of the opening 16 of overboot 12.

The lower surface of the sole 28 of overboot 12 includes sets of cleats located at any suitable location in order to provide the desired traction to secure footing on a slippery surface. Such sets of cleats are preferably around the periphery of the sole 28 and could include cleats 30 as illustrated located at the toe and heel portions of sole 28. Additional sets of cleats 32, 34 and 36 also extend from the sole. Preferably the cleats on one longitudinal side of overboot 12 are mirror images of those on the other longitudinal side.

As best shown in FIG. 2 a distinctive feature of traction cleats 36 is that each traction cleat includes a latch in the form of a cutout forming an exposed hook portion 38 facing toward the toe, for purposes later described. Other forms of latch structure could also be used instead of an exposed hook portion. Examples of such latch structure include various shaped cutouts or holes or any other form of opening which would be engaged by a catch on the snowdeck, as later described. The latch could also be an exposed protrusion on the cleat 36 for engagement with a catch on the snowdeck.

As illustrated in FIG. 4 overboot 12 could be lined with any suitable insulation material 29 to provide insulation and protection from snow, dirt or water infiltration of the footwear. The overboot itself would be made of materials conventionally used in snow conditions. Preferably, overboot 12 is made of neoprene. Additionally, the sole of the overboot is preferably textured as illustrated in provisional application Ser. No. 60/758,890. The cleats are made of a suitable metal material, such as stainless steel. Preferably the material used for the overboot upper is stretchy with reinforcement material strategically attached to the stretchy material for durability, to provide a means for buckle attachment for a non-stretchy (i.e., secure) strap harness and as a support. The metal cleats could be co-molded with the rubber outsole.

It is to be understood that although the drawings illustrate one overboot and one snowdeck, a complete system would, of course, be provided for each foot of the user.

Figure 8:
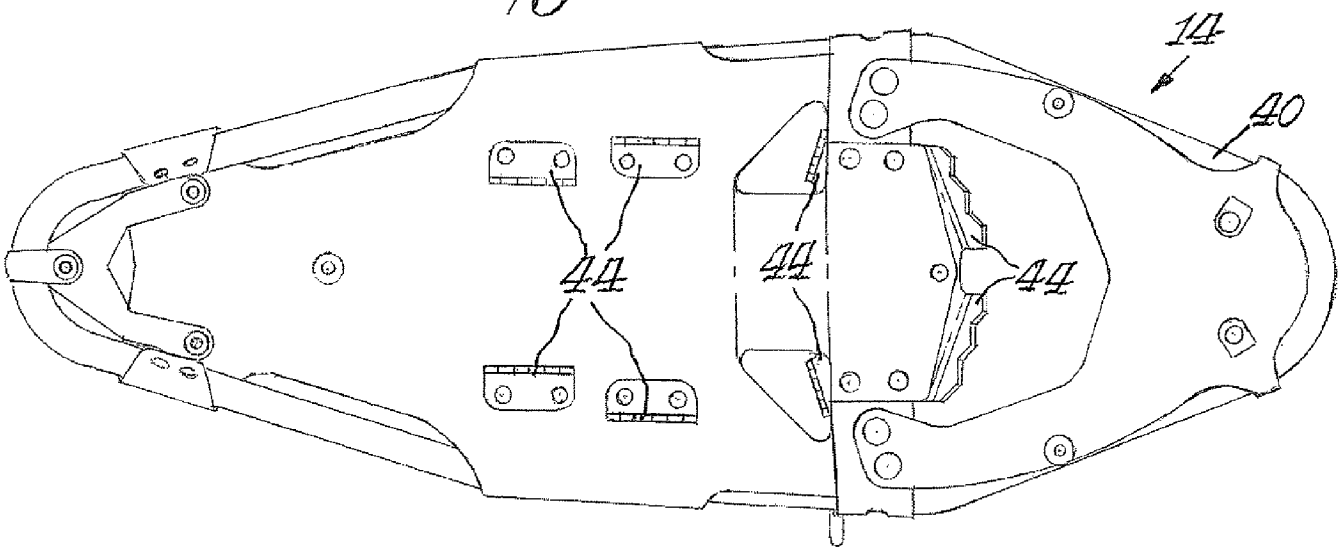
FIG. 8 is a bottom plan view of the snowdeck shown in FIGS. 5-7.

FIGS. 5-8 illustrate details of the snowdeck 14. As shown therein snowdeck 14 comprises a frame 40 which may be made of any suitable material such as a metal material conventionally used for snowdecks. Frame 40 has a generally flat portion which receives the overboot and may be inclined upwardly forwardly of where the user's foot (overboot) would be located. Any suitable decking material 42 spans the frame leaving openings as necessary or desired. As shown in FIG. 8 various sets of cleats or claws 44 are provided on the bottom of the decking 42 to further enhance traction for use on slippery surfaces and in deep snow. The claws 44 may be provided at any suitable locations and may be secured to webbing 42 in any suitable manner. Preferably the claws on one longitudinal side of the snowdeck 14 are mirror images of those on the other side.

A heel block 46 is mounted to a heel pad or support 48 provided on decking 42. Heel block 46 would be located between the sets of claws 44 located in the heel portion and would be of sufficient height to be surrounded by and generally elevate the overboot cleats 30,34 above decking 42 so as to not damage the decking when the overboot is mounted to the snowdeck by minimizing any digging of the cleats into the decking. The spacer aspect of the heel block may maintain the cleats generally out of contact but could permit some contact as long as damage to the decking is minimized. If desired, heel block 42 could include some form of catch, such as pins which may be selectively extended from the heel block, for engagement by the hook portion 38 of the cleats 34. Where, instead of a "snowdeck", the first traction component (e.g. overboot 12) is mounted to a ski, mounting to both the forefoot and rear foot may be desired. Accordingly, the term "snowdeck" is not intended to be limited to conventional snowdecks but could include various types of devices for attachment to the feet to assist movement in snow, such as snowshoes, skis or the like. For most uses of system 10, it is preferred that there be no physical attachment of the heel portion of the overboot with the snowdeck so that the user may readily pivot the user's foot by having attachment solely in the forefoot area as later described.

Heel block 46 may be mounted on the heel area decking 42 by being secured to the heel pad or support member 48 which contains a longitudinal slot 50 and two sets of transverse slots 52,52. See FIG. 6. This permits the location of heel block 46 to be varied for accommodating different size overboots. Thus, for example, heel block 46 could include engaging members detachably mounted in the front set of slots 52 to lock it in place or heel block 46 could be moved rearwardly in slot 50 and then engaged in rearward slots 52 where a larger size overboot is used.

The provision of a spacer such as heel block 46 to generally elevate the cleats of the traction component from the snowdeck 14 is a distinct advantage over prior arrangements. In that regard, a spacer assures that the cleats of a traction system in the heel area are prevented from generally contacting the snowshoe deck. Such spacer in the preferred form is a heel block, such as heel block 46 mounted directly to the snowdeck 14. The concept of a spacer, however, may also be practiced where, for example, the spacer is mounted (such as being detachably mounted) to the traction device or traction component so that it provides a spacing member of sufficient thickness to generally elevate the cleats from the snowshoe deck. The provision of such a spacer is advantageous over prior arrangements using, for example, cutouts in the snowshoe deck to avoid contact by the cleats of the traction system.

A key feature of this invention is the provision of a releasable locking mechanism 56 for selectively engaging the first traction component, such as overboot 12, with the snowdeck 14. The components of the releasable locking mechanism 56 are best shown in FIGS. 9-10 and its manner of operation is best illustrated in FIGS. 11-15.

Figure 9:
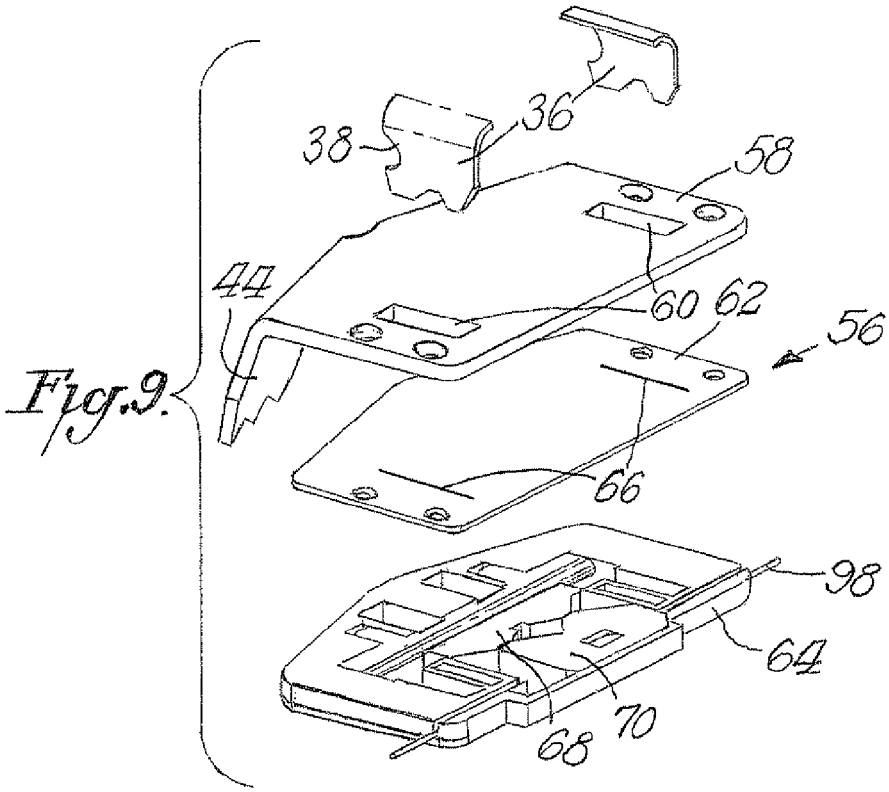
FIG. 9 is an exploded view showing traction cleats which would be mounted to the sole of the overboot and showing the components of the locking mechanism incorporated in the snowdeck in the system of FIG. 1.
Figure 10:
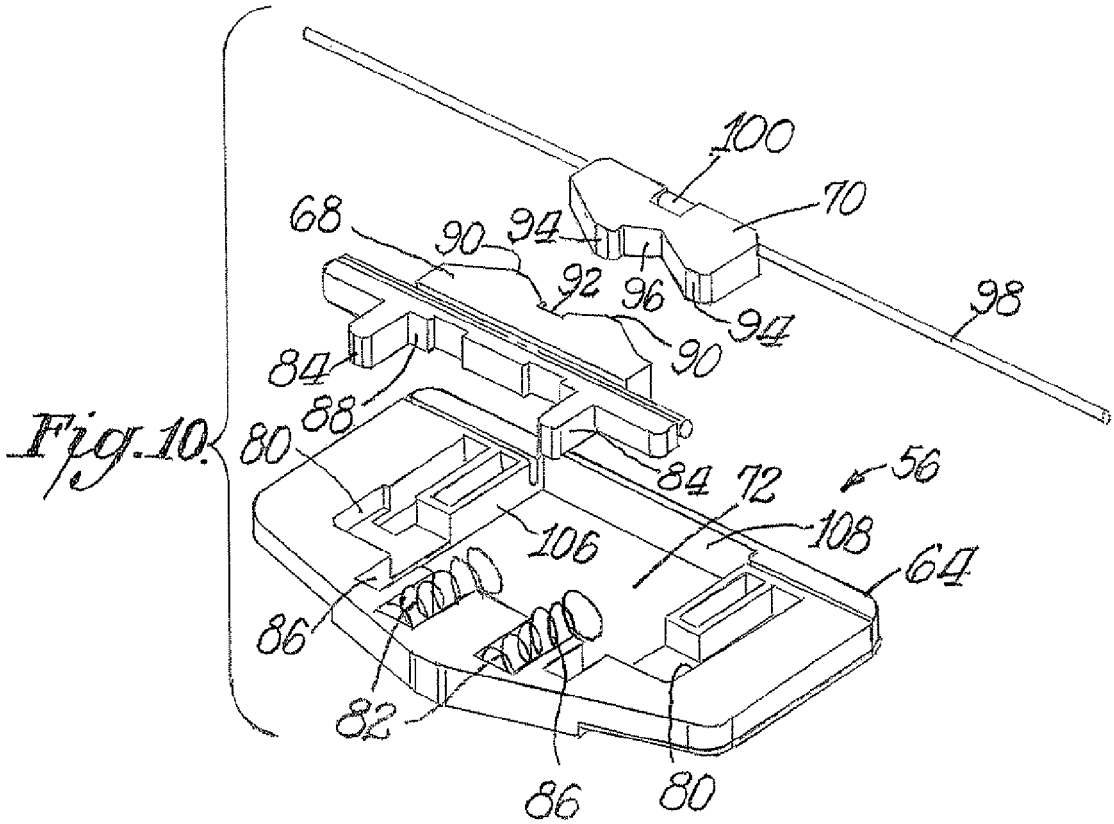
FIG. 10 is an exploded view showing components of the locking mechanism shown in FIG. 9.

As shown in FIG. 9 the traction cleats 36 of overboot 12 cooperate with the locking mechanism 56. The invention may be practiced where each cleat 36,36 is individually mounted to the sole 28 of overboot 12 by, for example, being embedded in an elastomeric mounting member which in turn is secured to the bottom of sole 28. Alternatively, cleats 36,36 and toe cleats 30,30 may be mounted to a common plate by being downward extensions of a plate 54 which would be incorporated in the sole 28 of overboot 12, such as illustrated in provisional application Ser. No. 60/758,890. It is to be understood that the invention could also be practiced where the cleats, particularly the cleats 36, are simply part of a binding that would be secured to conventional footwear and need not necessarily be part of an overboot.

FIG. 9 also illustrates the components of the releasable locking mechanism 56 that are incorporated in the snowdeck 14. These components include a plate 58 made of any suitable material such as metal which could have downwardly extending projections that form the claws 44. Plate 58 includes a pair of elongated slots 60 of a size and location to receive the cleats 36,36.

Under certain snow conditions it may be desirable to provide a gasket 62 mounted beneath the plate 58 which covers housing 64 in order to reduce snow or other contaminants infiltrating the locking mechanism. Gasket 62 is also provided with a pair of elongated slits 66 aligned with slots 60 of plate 58 so that the cleats 36 also extend through gasket 62. The slits 66 create a seal below slots 60 to minimize snow entering and contaminating the click-in locking mechanism.

Various components of the locking mechanism 56 located in housing 64 are illustrated in FIG. 10. As shown in FIG. 10 housing 64 includes a longitudinally movable slider 68 and a transversely movable slider 70 which fit in an appropriately shaped recess 72 of housing 64. Longitudinal slider 68 includes a groove 76 which receives a fastening rod 78 the ends of which would abut against walls 80,80 in housing 64. A pair of springs 82,82 are provided in housing 80. Longitudinal slider 68 has a pair of legs 84,84 which fit in appropriate recesses 86,86 in housing 64 when slider 68 is mounted in housing 64. Springs 82,82 press against wall 88 of longitudinal slider 68 to urge slider 68 in a longitudinal direction toward the opposite end of housing 64. Longitudinal slider 88 has a cam wall which includes a pair of projecting surfaces 90 and an intermediate recess 92.

Figure 6:
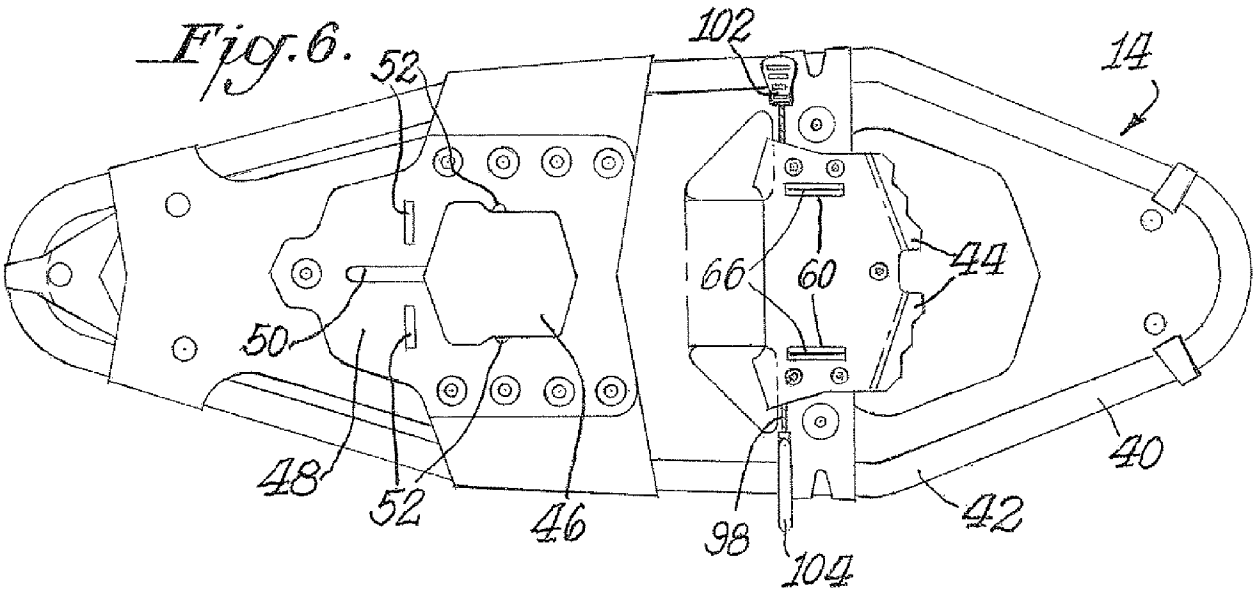
FIG. 6 is a top plan view of the snowdeck shown in FIG. 5.
Figure 5:
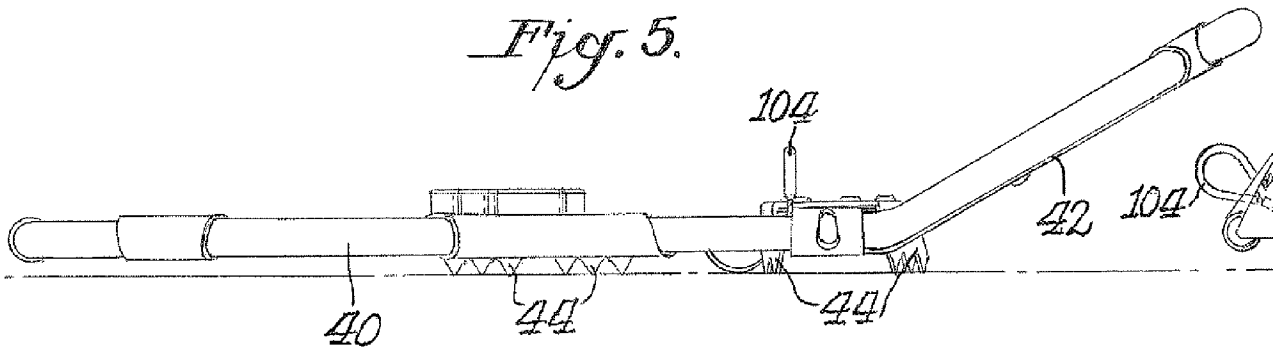
FIG. 5 is a side elevational view of a snowdeck used in the system of FIG. 1.
Figure 7:
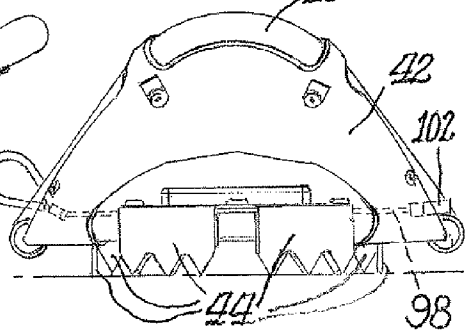
FIG. 7 is a front elevational view of the snowdeck shown in FIGS. 5-6.
Figure 12:
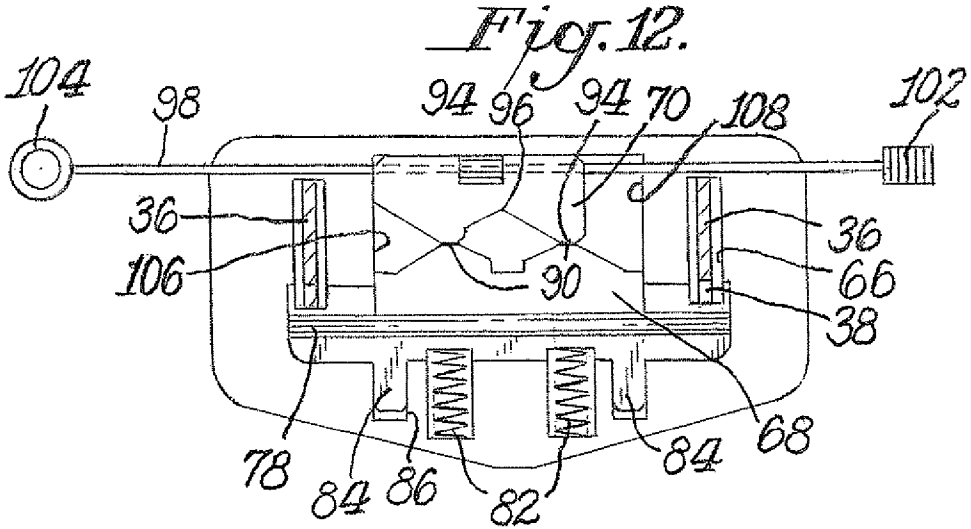
FIG. 12 is a top plan view of various components of the locking assembly shown in FIGS. 9-10 in the disengaged condition.
Figure 14:
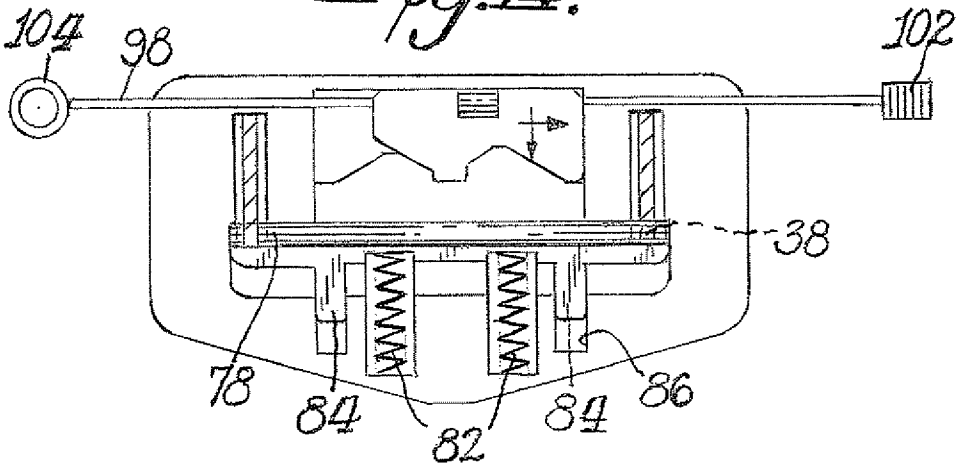
FIG. 14 is a view similar to FIG. 12 showing the components in the engaged position.

As also shown in FIG. 10 transverse slider 70 has a complementary cam wall which includes projections 94,94 and intermediate recess 96. The projections 90,90 of slider 68 and 94,94 of slider 70 preferably terminate in flat portions. A release/actuation member, such as a pull cord 98, is also provided in transverse slider 70. Pull cord 98 is fixedly mounted to sleeve 100 located in a notched portion of slider 70. Thus, when the pull cord is pulled to the right or to the left the slider 70 would also be shifted laterally to the right or to the left. As shown in FIGS. 6, 12 and 14 one end of pull cord 98 may have a handle 102 attached to that end, while the other end may have a handle 104. The handles may take any suitable form such as handle 102 being in the form of a block having grooves or ridges to facilitate gripping or could be a loop such as illustrated for handle 104.

Preferably the pull cord is made of a strong, yet bendable material such as a braided metal wire. Other suitable materials could be used and, although not as preferred, the pull cord itself could be a stiff non-bendable member since the main requirement is that it have sufficient strength to be pulled in a transverse direction and that it is coupled to the transverse slider so that the lateral pulling is transmitted to the transverse slider to cause the transverse slider to shift back and forth to and from its locking and unlocking conditions.

Figure 11:
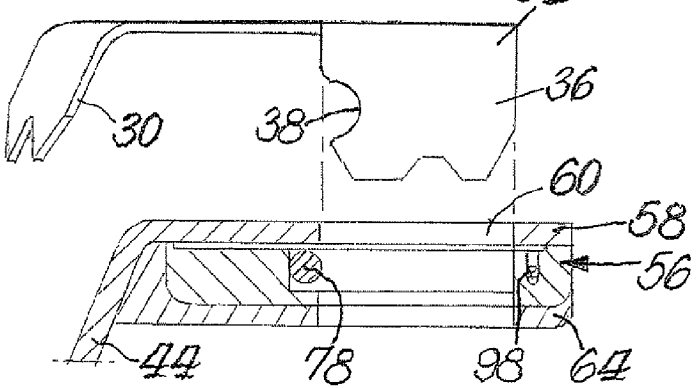
FIG. 11 is a fragmental exploded view showing components of the locking mechanism and the overboot cleats in an initial stage of mounting.
Figure 13:
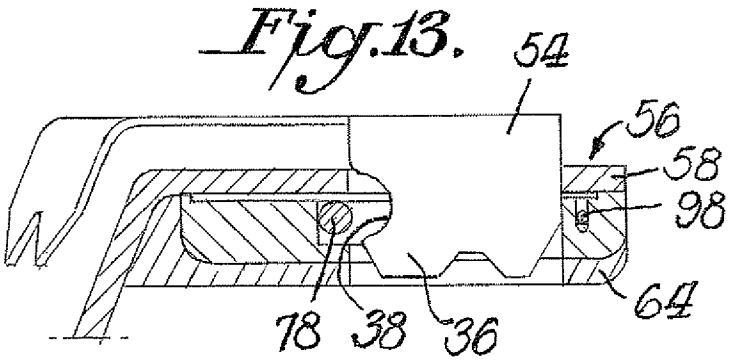
FIG. 13 is an elevational view in section showing the traction cleat of the overboot in the disengaged condition.
Figure 15:
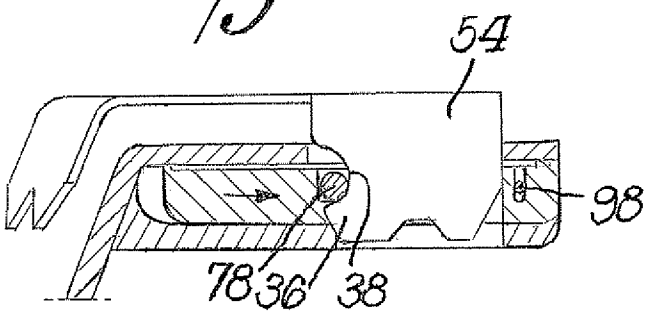
FIG. 15 is a view similar to FIG. 13 showing the components in the engaged position.

FIGS. 11-13 illustrate the condition of the locking mechanism when in the disengaged or the about to be engaged position. As shown therein handle or loop 104 has been pulled to move slider 70 toward the left. When in this position the cam faces of slider 70 press against longitudinal slider 68 to force the longitudinal slider 68 rearwardly with the springs 82 in a compressed condition. While in this position transverse slider 70 is disposed against wall 106 in recess 72 of housing 64 and is stopped in this position. The flat portions at the end of the projections 90 of longitudinal slider 68 and projections 94 of transverse slider 70 abut against each other to maintain longitudinal slider 68 in the retracted condition, best shown in FIG. 12. When in this position the fastening rod 78 is moved to its retracted or disengaged position out of the path of movement of cleats 36 when they enter the housing 64 through the slots 60,60 and 66,66 of the plate 58 and gasket 62. FIG. 11 shows the cleat 36 before it enters the slot 60. FIG. 13 shows how cleat 36 is able to freely pass into the housing 64 without interference from retracted fastening rod 78. In this manner, the wearer simply places the cleats 36,36 on the plate 58 of the snowdeck 14 at the location of the slots 60,60 and merely steps downwardly at the forefoot area to insert the cleats 36,36 into the locking mechanism 56.

After cleats 36 have been rally inserted into the housing 64 (FIG. 13), the wearer pulls handle 102 which causes transverse slider 70 to shift in the opposite direction from that shown in FIG. 12 to the position shown in FIG. 14. When in this position the side wall of slider 70 comes into contact with wall 108 of housing 64 and is stopped in this position. When moved to the position shown in FIG. 14 the projection cam surfaces 94,94 of transverse slider 70 no longer contact the projection cam surfaces 90,90 of longitudinal slider 68. Instead the recess 96 of transverse slider 70 is located at the right cam projection 90 of longitudinal slider 68 with the other or left cam projection 90 being against the complementary shaped inclined wall of the cam face of transverse slider 70 as illustrated in FIG. 14. Longitudinal slider 68 occupies this position by being urged outwardly under the influence of springs 82,82. When moved to this position, longitudinal slider 68 also carries fastening rod 78 forwardly with it whereby fastening rod 78 enters the exposed hook shaped portions 38,38 of cleats 36,36. This is then the locking or engaged condition of the locking mechanism 56. When in this locked condition overboot 12 is securely mounted to snowdeck 14 in the location of the traction cleats 36,36. As previously indicated in the preferred practice of this invention this is the only area where overboot 12 is locked to snowdeck 14 so that the wearer is thereby able to pivot the overboot in, for example, the heel area. The dimensions of traction cleats 36 with regard to the locking mechanism 56 and particularly the thickness of housing 64 is such that the cleats 30,32 and 36 remain elevated out of contact with the webbing 42. In that regard, cleats 30,30 and 32,32 surround the locking mechanism 56, while cleats 36,36 are in the locking mechanism. Since locking mechanism 56 is thicker than the length of these cleats, the cleats are thereby spaced from webbing 42.

When it is desired to remove overboot 12 from snowdeck 14 handle 104 is pulled to shift transverse slider 70 back to the position shown in FIG. 12 which results in returning longitudinal slider 68 to its retracted position so that fastening rod 78 is removed from hook portion 38 and cleats 36 can then be removed from the locking mechanism 56 by the wearer simply raising the foot away from the snowdeck 14. Alternatively, the locking mechanism 56 could remain in the locking condition and the wearer could simply remove the foot from the overboot so that the overboot 12 remains mounted to snowdeck 14 during periods of non-use. Thus the assembly which comprises the overboot 10 and the snowdeck 14 could be stored together as a single unit or could be separated from each other as previously described.

Although the above description and the drawings include the provision of an exposed hook 38 in the cleat 36 which is engaged by the locking mechanism, other forms of latch members may be used. For example, instead of an exposed hook, the latch member could be a hole or cutout in the cleat which would be selectively engaged by the movement of a bar functioning as the catch member in the locking mechanism. Such bar could be a bar of circular cross-section fitting in a circular or round hole or cutout. Alternatively, the latch might be a protrusion on the cleat 36 which would be engaged with a catch movable into the path of movement of the protrusion when the traction cleat 36 has entered the locking mechanism. The locking mechanism itself could take any suitable form such as being part of a strap system which would have a catch member movable into the path of movement of the latch.

It is to be understood that where reference is made to a releasable locking mechanism, such locking mechanism could be of the type specifically illustrated and described or could be a strap system incorporating the components to effect the selective engagement and disengagement with the cleat of the traction component.

An advantageous feature of this invention is that an audible click is heard when the transverse slider is moved to its locking condition and is moved to its unlocking condition. This provides assurance to the wearer that the overboot has been appropriately locked to or released from the snowdeck.

The present system provides an advantageous manner of mounting the traction component to the snowshoe deck. When, for example, the cleat 36 is mated with the locking mechanism and in particular with the plate 58 by entering its slot 60, the cleat 36 is held strongly from rotating in nearly all planes even without the bar or rod 78 being clicked into place. This "nesting" of the two components assures a very secure connection and allows the cleat 36 to be removed by moving it in the vertical direction in a single plane perpendicular to the slot. Thus, while the click-in bar is important, there is still much stability built into the design even without the bar.

The preferred practice of this invention utilizes a set of two traction cleats 36,36 which cooperate with the locking mechanism having two sets of slots. The invention, however, could also be practiced with only one or with more than two of such traction cleats 36 with appropriate modification of the locking mechanism.

It is to be understood that the above description with regard to the illustrated preferred embodiment of this invention is not intended to be limiting and that the invention could be practiced with different variations. Reference is made to provisional application Ser. No. 60/758,890, filed Jan. 12, 2006, all of the details of which are incorporated herein by reference thereto. Among the variations described in that provisional application are the use of a detachable binding for the snowdeck instead of an overboot whereby the binding could be attached to suitable footwear such as running shoes. Thus, the cleats 36 described with regard to the overboot, could be part of a separate binding where the invention is practiced without an overboot. Other variations described in the provisional application include the use of a cradle which could be inserted within an overshoe, which would be another alternative to the use of the overboot described and illustrated in FIGS. 2-4.

What is claimed is:

1. An improved traction system comprising a first traction component, said first traction component having fastening structure for attachment to foot/footwear, said first traction component having at least one traction cleat, a snowdeck, and said snowdeck having a releasable locking mechanism including a catch which is movable to and from its locking condition and its disengaging condition with said at least one cleat for selective engagement with said at least one cleat for selectively mounting said first traction component to said snowdeck and for selectively disengaging said first traction component from said snowdeck.

2. The system of claim 1 wherein said at least one traction cleat includes a latch, said catch being movable into the path of movement of said latch when said traction cleat has entered said locking mechanism for being received in said exposed hook portion when said locking mechanism is in its locking condition and for being disposed out of contact with said latch when said locking mechanism is in its disengaging position, and said locking mechanism including an activating member for selectively moving said catch to and from said locking condition and said disengaging position.

3. The system of claim 2 wherein said latch is an exposed cut-out in said traction cleat.

4. The system of claim 2 wherein said catch comprises a fastening rod mounted to a longitudinal slider capable of sliding back and forth in a longitudinal direction, said longitudinal slider having a cam face, said activating member comprising a release/actuation member mounted on a transverse slider which is slidably movable in a lateral direction, said transverse slider having a cam face disposed against said cam face of said longitudinal slider, and the lateral shifting of said transverse slider controlling the longitudinal movement of said longitudinal slider to selectively dispose said fastening rod into and out of engagement with said latch of said traction cleat.

5. The system of claim 4 wherein said release/actuation member is a pull cord having an exposed handle at each end.

6. The system of claim 5 wherein said locking mechanism includes a housing mounted to said snowdeck, said longitudinal slider and said transverse slider being slidably mounted in said housing, and at least one spring member urging said longitudinal slider into its locking condition.

7. The system of claim 6 wherein each of said cam face on said longitudinal slider and on said transverse slider includes a pair of projections with an intermediate recess spacing said projections apart so that when the tips of said projections of said sliders abut each other said longitudinal slider is moved to said disengaging position, and when said projections are aligned with said recesses said longitudinal slider is moved to said locking condition.

8. The system of claim 7 wherein said locking mechanism further includes a plate mounted over said housing, and a slot extending through said plate for permitting said at least one traction cleat to pass through said plate and enter said housing.

9. The system of claim 8 wherein said at least one traction cleat comprises a set of two spaced generally parallel traction cleats, said plate having a slot for each of said traction cleats, a gasket mounted below said plate, and said gasket having a sealing slit in line with each of said plate slots.

10. The system of claim 9 wherein said pull cord is mounted in a sleeve disposed in a notch in said transverse slider.

11. The system of claim 10 wherein said releasable locking mechanism and said at least one traction cleat are mounted in the forefoot area of said traction component, and the wearer being free to pivot the wearer's foot at the heel when said first traction component is mounted to and engaged with said snowdeck.

12. The system of claim 11 wherein said first traction component comprises an overboot, said at least one traction cleat being located at the forefoot area of said overboot, and a plurality of further sets of traction cleats being disposed around the sole portion of said overboot.

13. The system of claim 12 wherein said overboot includes an insulated lining, said overboot having an opening for insertion of a wearer's foot/footwear above the heel portion of said overboot, and fastening structure for tightening said opening after the wearer's foot/footwear is inserted.

14. The system of claim 12 wherein said fastening structure includes a loop mounted on each side of said overboot, strap structure slidably mounted to each of said loops for adjusting the position of said strap structure up and down said loops, and a fastener mounted to said strap structure.

15. The system of claim 12 wherein said snowdeck includes a plurality of claws for providing traction, and at least some of said claws extending downwardly at spaced locations from said housing plate.

16. The system of claim 15 wherein said snowdeck comprises a frame, a decking spanning portions of said frame, and at least some of said claws mounted to said decking.

17. The system of claim 16 including a heel block mounted to a heel pad mounted to said decking, and said heel block being of sufficient thickness to elevate said cleats of said overboot out of contact with said decking.

18. The system of claim 17 wherein said heel block is longitudinally movable to different longitudinal positions for accommodating different size overboots.

19. The system of claim 18 wherein said frame is upwardly angled forwardly of said overboot.

20. The system of claim 1 wherein said locking mechanism includes a plate having at least one elongated slot, and said at least one traction cleat being insertable into said slot for preventing said cleat from rotating whereby said cleat is movable into and out of said slot by movement in a plane perpendicular to said slot.

21. The system of claim 1 wherein said first traction component has a heel portion, at least one further traction cleat mounted to and extending outwardly from said heel portion, said snowdeck having decking including a heel area located at said heel portion of said first traction component when said first traction component is engaged with said snowdeck, a spacer between said heel portion of said first traction component and said heel area of said decking, and said spacer being of sufficient thickness to maintain said at least one further traction cleat of said first traction component generally out of contact with said decking when said first traction component is engaged with said snowdeck.

22. The system of claim 21 wherein said spacer comprises a heel block mounted to said decking.

23. The system of claim 22 wherein said heel block is mounted to a heel pad which is mounted to said decking, and said heel block being selectively longitudinally movable on said heel pad to different longitudinal positions for accommodating different size first traction components.

24. An improved traction system comprising a first traction component, said first traction component having fastening structure for attachment to foot/footwear, said first traction component having a heel portion, a snowdeck, locking structure for selective engagement of said first traction component with said snowdeck and for selectively disengaging said first traction component from said snowdeck, said snowdeck including a decking having a heel area, a spacer located between said heel portion of said first traction component and said heel area of said decking, and said spacer being of sufficient thickness to maintain said at least one traction cleat of said heel portion generally out of contact with said decking when said first traction component is engaged with said snowdeck.

25. The system of claim 24 wherein said spacer comprises a heel block mounted to said decking.

26. The system of claim 25 wherein said heel block is mounted to a heel pad which is mounted to said decking, and said heel block being selectively longitudinally movable on said heel pad to different longitudinal positions for accommodating different size first traction components.

27. In an overboot for use on a slippery surface wherein said overboot includes an opening for insertion of a wearer's foot/footwear and wherein said overboot includes a sole having a toe portion and a heel portion, a plurality of traction cleats extending downwardly from said sole, the improvement being in that said plurality of cleats comprises a set of cleats at said toe portion and a set of cleats at said heel portion and sets of intermediate cleats, said plurality of cleats being non-detachably mounted to said sole, at least one of said sets of said intermediate cleats being located in the forefront area of said sole and having a latch for selective mounting to a snowdeck, and said latch being an exposed cut-out in each of said traction cleats of said at least one of said sets of said intermediate cleats to form an exposed hook portion for receiving a movable catch on the snowdeck.

28. The system of claim 27 wherein said overboot has an overboot loop on each side of said opening, strap structure slidably mounted to each of said overboot loops for adjusting the position of said strap structure up and down said overboot loops, said strap structure comprising a strap having a strap loop at each end, each of said overboot loops extending through a respective one of said strap loops, and fastener structure mounted to said strap structure for adjusting the size of said opening.

29. The system of claim 28 wherein said strap structure includes a plurality of spaced transverse teeth, and said fastener structure including a ratchet selectively engaged with said teeth.

30. A snowdeck for use with a first traction component, said snowdeck comprising a frame, a decking spanning parts of said frame, said frame having a heel portion and a forefoot portion, a releasable locking mechanism located at said forefoot portion, said releasable locking mechanism comprising a housing, a longitudinal slider in said housing, a transverse slider in said housing, said longitudinal slider being mounted for longitudinal sliding movement, said transverse slider being mounted for lateral sliding movement, each of said sliders having a cam face, each of said cam faces having at least one projection and an adjacent recess, said transverse slider being laterally slidable to dispose its at least one projection against said at least one projection of said longitudinal slider to longitudinally move said longitudinal slider rearwardly to a disengaging position, said transverse slider being laterally movable to a position where said projections of said cam faces are out of contact with each other to permit said longitudinal slider to move longitudinally forwardly in an engaging direction, said longitudinal slider carrying a fastening rod, and said transverse slider having a release/actuation member for controlling the lateral sliding movement of said transverse slider.

31. The snowdeck of claim 30 including a plate mounted over said housing, said plate having a pair of spaced generally parallel slots for receiving cleats of a traction component which is to be detachably mounted to said snowdeck, a gasket mounted below said plate, said gasket having a sealing slit below and in alignment with each of said slots, said release/actuation member comprising a pull cord mounted in a sleeve connected to said transverse slider, and a handle at each end of said pull cord.

32. The system of claim 30 wherein a heel block is mounted to and extends upwardly from said decking for maintaining cleats on the first traction component generally out of contact with said decking.

33. The system of claim 30 wherein said heel block is mounted to a heel pad which is mounted to said decking, and said heel block being selectively longitudinally movable on said heel pad to different longitudinal positions for accommodating different size first traction components.

* * * * *